US007758388B2

(12) United States Patent
Xu et al.

(10) Patent No.: US 7,758,388 B2
(45) Date of Patent: Jul. 20, 2010

(54) ELECTRICAL CONNECTOR ASSEMBLY WITH IMPROVED CONTACT ARRANGEMENT

(75) Inventors: Bin Xu, KunShan (CN); Su-Feng Liu, KunShan (CN); David Tso-Chin Ko, Fullerton, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/586,137

(22) Filed: Sep. 16, 2009

(65) Prior Publication Data

US 2010/0068939 A1 Mar. 18, 2010

(30) Foreign Application Priority Data

Sep. 16, 2008 (CN) ..... 2008 1 0304513

(51) Int. Cl.
*H01R 33/94* (2006.01)

(52) U.S. Cl. ..... 439/651; 439/852

(58) Field of Classification Search ..... 439/76.1, 439/76.2, 650–654, 852
See application file for complete search history.

(56) References Cited

U.S. PATENT DOCUMENTS 5,899,773 A * 5/1999 Cheng ..... 439/651
6,955,567 B2 * 10/2005 Inaba et al. ..... 439/651
6,974,351 B1 * 12/2005 Lauk et al. ..... 439/651
7,094,109 B2 * 8/2006 Chou ..... 439/651

* cited by examiner

*Primary Examiner*—Khiem Nguyen
(74) *Attorney, Agent, or Firm*—Wei Te Chung; Andrew C. Cheng; Ming Chieh Chang

(57) ABSTRACT

An electrical connector assembly comprises a receptacle connector (100) and a plug connector (200) mating with the receptacle connector. The receptacle connector (100) has a receptacle housing (10) and a plurality of receptacle contacts (12) received in the receptacle housing, and the receptacle housing comprises a base portion (102) and an expansion portion (104) extending outwards from the base portion. The plug connector comprises a plug housing (20) and a plurality of plug contacts (21) retained in the plug housing. Each of the receptacle contacts and the plug contacts define a mating portion (121, 211), a retention portion (123, 213) retained with associated housing and a tail portion (124, 214) extending beyond the associated housing. The receptacle contacts and the plug contacts are divided into two groups respectively, each group of contacts comprises two pairs of differential signal contacts (12*a*, 12*b*, 12*d*, 12*e*, 21*a*, 21*b*, 21*d*, 21*e*) transmitting signal and a grounding contact (12*c*, 21*c*) arranged between the two pairs of differential signal contacts, and one of the two pairs of the differential signal contacts (12*d*, 12*e*, 21*d*, 21*e*) are located on an outer side of the group of contacts.

9 Claims, 10 Drawing Sheets

ELECTRICAL CONNECTOR ASSEMBLY WITH IMPROVED CONTACT ARRANGEMENT

BACKGROUND OF THE INVENTION

1. Field of the Invention

The present invention generally relates to an electrical connector assembly, and more particularly to an electrical connector assembly including a receptacle connector and a plug connector transmitting high-speed signal.

2. Description of Related Art

Personal computers (PC) are used in a variety of ways for providing input and output. Universal Serial Bus (USB) is a serial bus standard to the PC architecture with a focus on computer telephony interface, consumer and productivity applications. The design of USB is standardized by the USB Implementers Forum (USB-IF), an industry standard body incorporating leading companies from the computer and electronic industries. USB can connect peripherals, such as mouse devices, keyboards, PDAs, gamepads and joysticks, scanners, digital cameras, printers, external storage, networking components, etc. For many devices such as scanners and digital cameras, USB has become the standard connection method. As of 2006, the USB specification was at version 2.0 (with revisions). The USB 2.0 specification was released in April 2000 and was standardized by the USB-IF at the end of 2001. Previous notable releases of the specification were 0.9, 1.0, and 1.1. Equipment conforming to any version of the standard will also work with devices designed to any previous specification (known as: backward compatibility).

USB supports three data rates: 1) A Low Speed rate of up to 1.5 Mbit/s (187.5 KB/s) that is mostly used for Human Interface Devices (HID) such as keyboards, mice, and joysticks; 2) A Full Speed rate of up to 12 Mbit/s (1.5 MB/s); (Full Speed was the fastest rate before the USB 2.0 specification and many devices fall back to Full Speed. Full Speed devices divide the USB bandwidth between them in a first-come first-served basis and it is not uncommon to run out of bandwidth with several isochronous devices. All USB Hubs support Full Speed); 3) A Hi-Speed rate of up to 480 Mbit/s (60 MB/s).

As the development of the electronic devices, under a circumstance transmitting an audio or video file, which is always up to hundreds MB, even to 1 or 2 GB, currently transmission rate of USB is not sufficient. As a consequence, faster serial-bus interfaces are being introduced to address different requirements. PCI Express, at 2.5 GB/s, and SATA, at 1.5 GB/s and 3.0 GB/s, are two examples of High-Speed serial bus interfaces.

However, these non-USB protocols are not used as broadly as USB protocols. Many portable devices are equipped with USB connectors other than these non-USB connectors. One important reason is that these non-USB connectors contain a greater number of signal pins than an existing USB connector and are physically larger as well. Therefore, USB 3.0 interface was published. The existing electrical connector assembly in a mainframe can transmit signals of USB 2.0 connector on a back panel to a main board, but can't transmit high-speed signals of USB 3.0 connector, so the signals between the back panel and the main board can't be transmitted mutually.

Hence, it is desirable to have an improved electrical connector assembly to overcome the above-mentioned disadvantages of the prior art.

BRIEF SUMMARY OF THE INVENTION

Accordingly, the object of the present invention is to provide an electrical connector assembly used for transmitting high-speed signal between a main board and a back panel.

In order to achieve the above-mentioned object, an electrical connector assembly in accordance with the present invention comprises a receptacle connector and a plug connector mating with the receptacle connector. The receptacle connector has a receptacle housing and a plurality of receptacle contacts received in the receptacle housing, and the receptacle housing comprises a base portion and an expansion portion extending outwards from the base portion. The plug connector comprises a plug housing and a plurality of plug contacts retained in the plug housing. Each of the receptacle contacts and the plug contacts define a mating portion, a retention portion retained with associated housing and a tail portion extending beyond the associated housing. The receptacle contacts and the plug contacts are divided into two groups respectively, each group of contacts comprises two pairs of differential signal contacts and a grounding contact arranged between the two pairs of differential signal contacts, and one of the two pairs of differential signal contacts are located on an outer side of the group of contacts.

Other objects, advantages and novel features of the invention will become more apparent from the following detailed description of the present embodiment when taken in conjunction with the accompanying drawings.

DETAILED DESCRIPTION OF THE INVENTION

Figure 1:
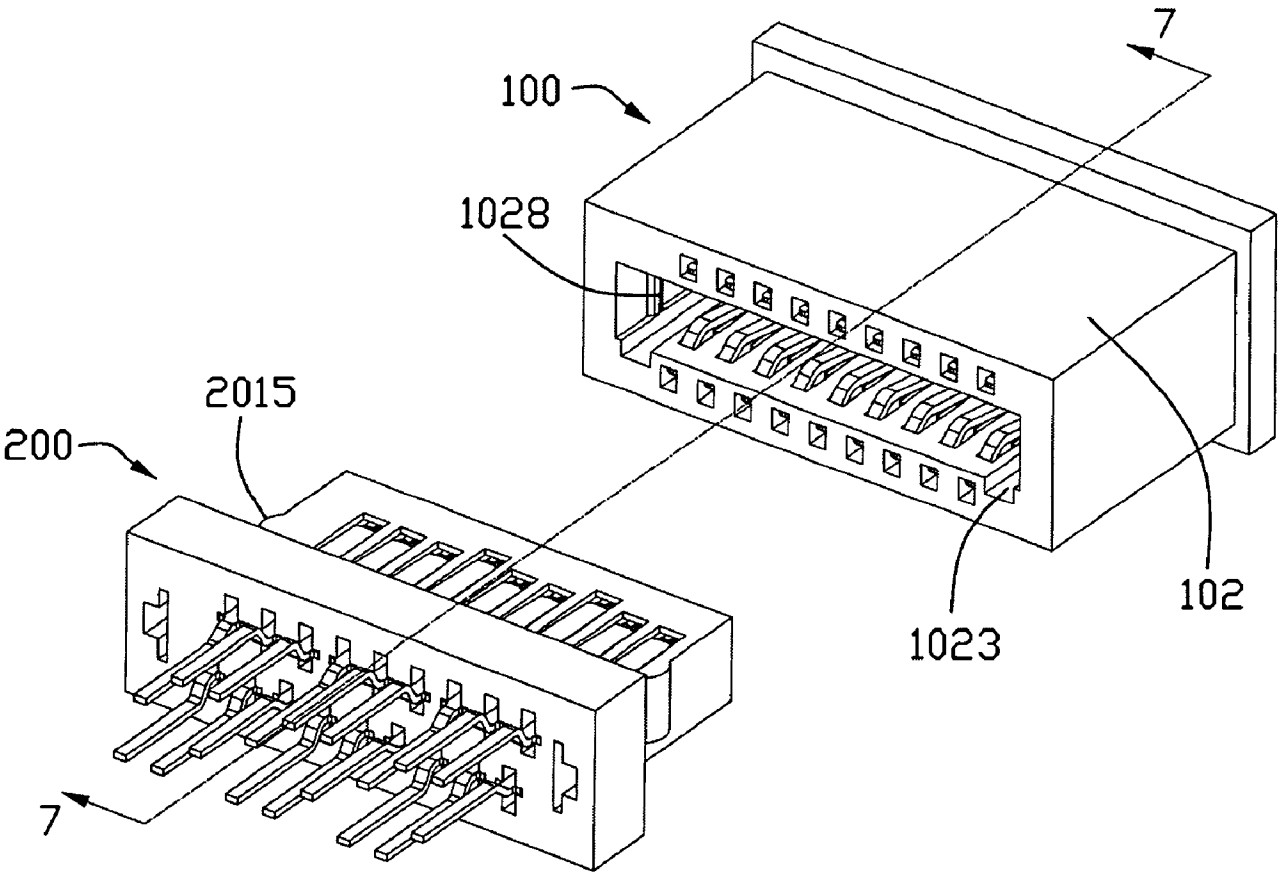
FIG. 1 is an assembled view of an electrical connector assembly including a receptacle connector and a plug connector of the first embodiment in accordance with the present invention.

Reference will now be made to the drawing figures to describe the present invention in detail.

Referring to FIGS. 1-4, an electrical connector assembly of a first embodiment made in accordance with the present invention includes a receptacle connector 100 and a plug connector 200. The receptacle connector 100 comprises a receptacle insulated housing 10, a plurality of receptacle contacts 12 retained in the receptacle insulated housing 10, a spacer 13 assembled to a back end of the receptacle insulated housing 10. The receptacle connector 100 also has a number of wires (not shown) electrically connected with the receptacle contacts 12 and a cover (not shown) enclosing the electrical conjunction between the wires and the receptacle contacts 12. The cover can be molded on a rear section of the receptacle insulated housing 10, and also can be of multi-configuration assembled to each other.

The receptacle insulated housing 10 comprises a base portion 102 and an expansion portion 104 extending backwards from the base portion 102. The base portion 102 defines a cavity 1020 recessed backward from a front surface thereof, the cavity 1020 is of n-shape and has a pair of guiding slots 1023 on lateral sides thereof. Two platforms 1021 are formed in the cavity 1020, each platform 1021 defines a plurality of receiving grooves 1025 arranged in juxtaposed manner, a plurality of receiving channels 1026 are defined through walls of the base portion 102 and communicated with corresponding receiving grooves 1025. The expansion portion 104 has an opening 1041 in a back end thereof. A pair of ribs 1028 are disposed in the cavity 1020 along an up-to-down direction.

Figure 3:
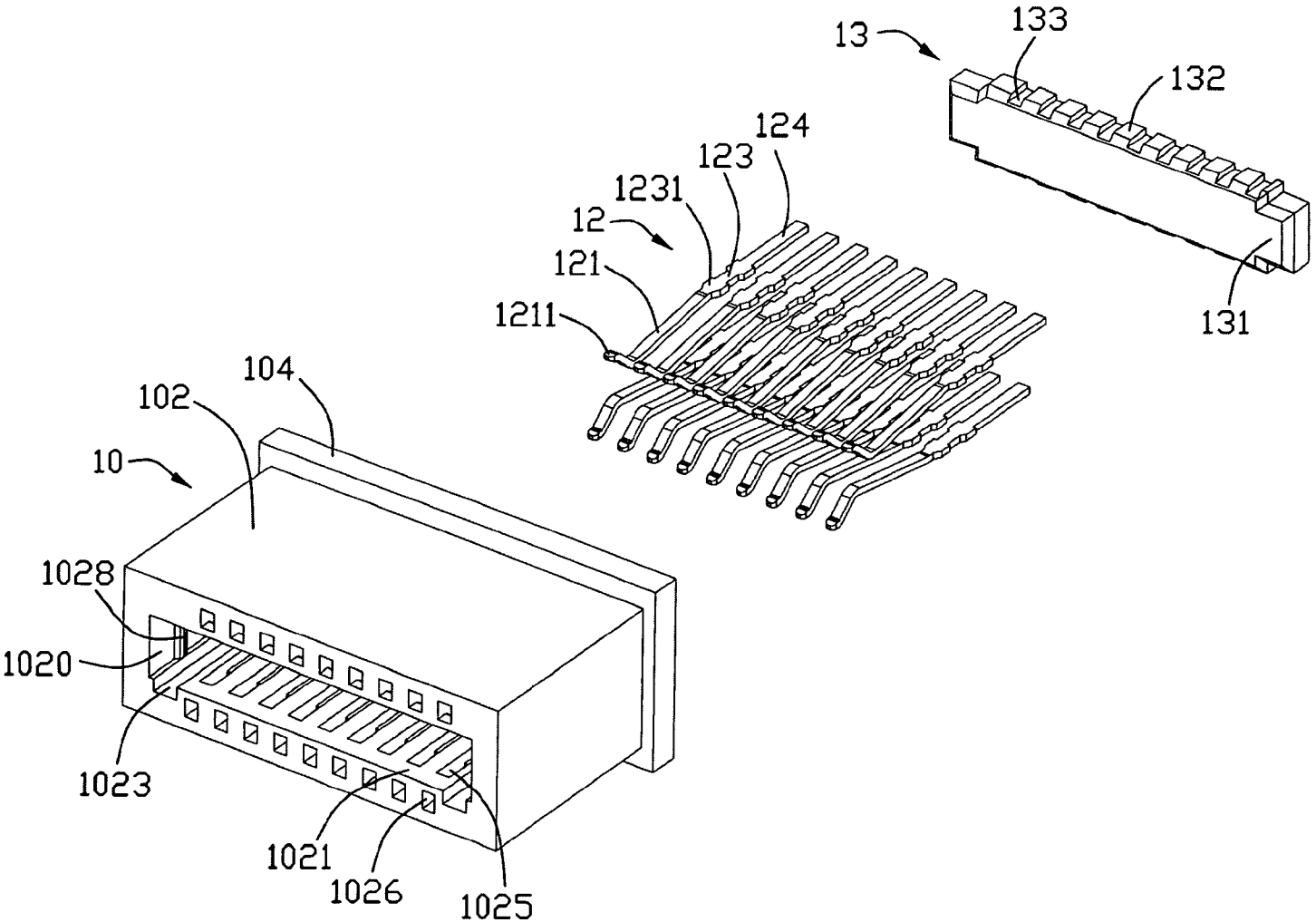
FIG. 3 is an exploded perspective view of the receptacle connector shown in FIG. 1.
Figure 4:
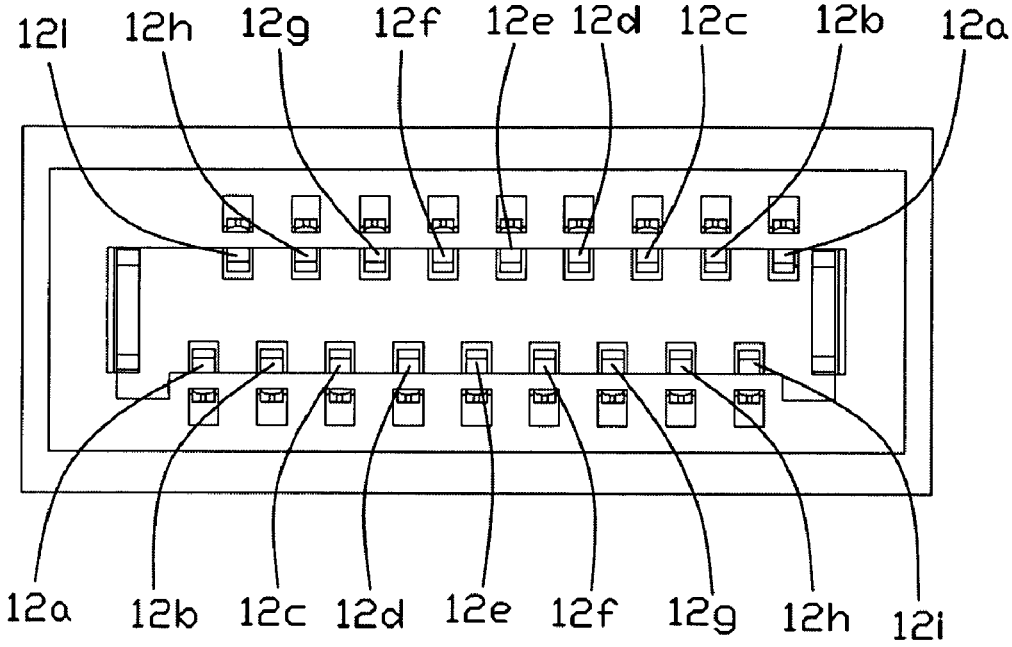
FIG. 4 is a front view of the electrical connector assembly shown in FIG. 2.

Referring to FIGS. 3-4, the receptacle contacts 12 are divided into a top group and a bottom group, the top group receptacle contacts are opposite to the bottom group receptacle contacts, and the two groups are in mirror relationship, but the arrangement orders of the two groups are reversed from each other. Each group comprises nine juxtaposed receptacle contacts 12, each receptacle contact 12 has a first mating portion 121 on a front end, a first tail portion 124 on a back end and a first retention portion 123 connected with the first mating portion 121 and the first tail portion 124. The first mating portions 121 are curved and received in the receiving grooves 1025 with top ends exposed out of the receiving grooves 1025. Each first retention portion 123 defines a plurality of barbs 1231 symmetrically. Each first mating portion 121 of the top group of receptacle contacts 12 extends from a front end of the first retention portion 123 forwards and downwards firstly, then upwards, and finally forms a first tip end 1211. When mating with the plug connector 200, the curved first mating portions 121 can make better contact with the plug connector 200. In another alternative embodiment, the receptacle contacts 12 may be designed with other configurations.

Referring to FIG. 4, the top group of receptacle contacts 12 are labeled as 12*a* to 12*i* from right to left respectively, and comprises two pairs of first differential signal contacts 12*a*, 12*b*, 12*d*, 12*e*, two first grounding contacts 12*c*, 12*f* (GND), a first positive signal contact 12*g* (+ data contact), a first negative signal contact 12*h* (– data contact) and a first power contact 12*i*. One of the two pairs of the first differential signal contacts 12*a*, 12*b* are used for receiving a high-speed data, and another pair 12*d*, 12*e* used for sending the high-speed data. The first differential signal contacts 12*a*, 12*d* are positive, and the first differential signal contacts 12*b*, 12*e* are negative. One of the first grounding contacts 12*c* is arranged between the two pairs of first differential signal contacts to reduce cross-talk. Another first grounding contact 12*f* is arranged between the first differential signal contacts 12*d*, 12*e* and the first data contacts 12*g*, 12*h* for preventing cross-talk. The first power contact 12*i* is located neighboring to the – data contact 12*h* and on an outer side of the – data contact 12*h*.

The spacer 13 is tabulate and placed along a vertical direction approximately, and the shape of the spacer 13 is same as the opening 1041. The spacer 13 comprises a rectangle plank 131 and a number of bars 132 protruding from an upper surface and a lower surface outwards. Each two neighboring bars 132 is spaced from each other to form a gap 133, the tail portions 124 of the receptacle contacts 12 are supported in the corresponding gaps 133.

In assembling, the receptacle contacts 12 are inserted into the receptacle insulated housing 10 along a back-to-front direction, the first mating portions 121 are accommodated in the receiving grooves 1025 with the top ends exposed on the platforms 1021. The first tip ends 1211 of the first mating portions 121 are located in the receiving channels 1026, and an upper surface of each first tip end 1211 is adjacent to a top surface 1027 of the receiving channel 1026 to prevent the first mating portion 121 jumping out. The first retention portions 123 are held in the receptacle housing 10 via the barbs 1231. The first tail portions 124 of the receptacle contacts 12 extend beyond the receptacle housing 10, and the spacer 13 is assembled in the opening 1041 of the receptacle housing 10, the first tail portions 124 are supported in the gaps 133 and soldered to wires (not shown), then a cover (not shown) is enclosed on the electrical connection.

Figure 2:
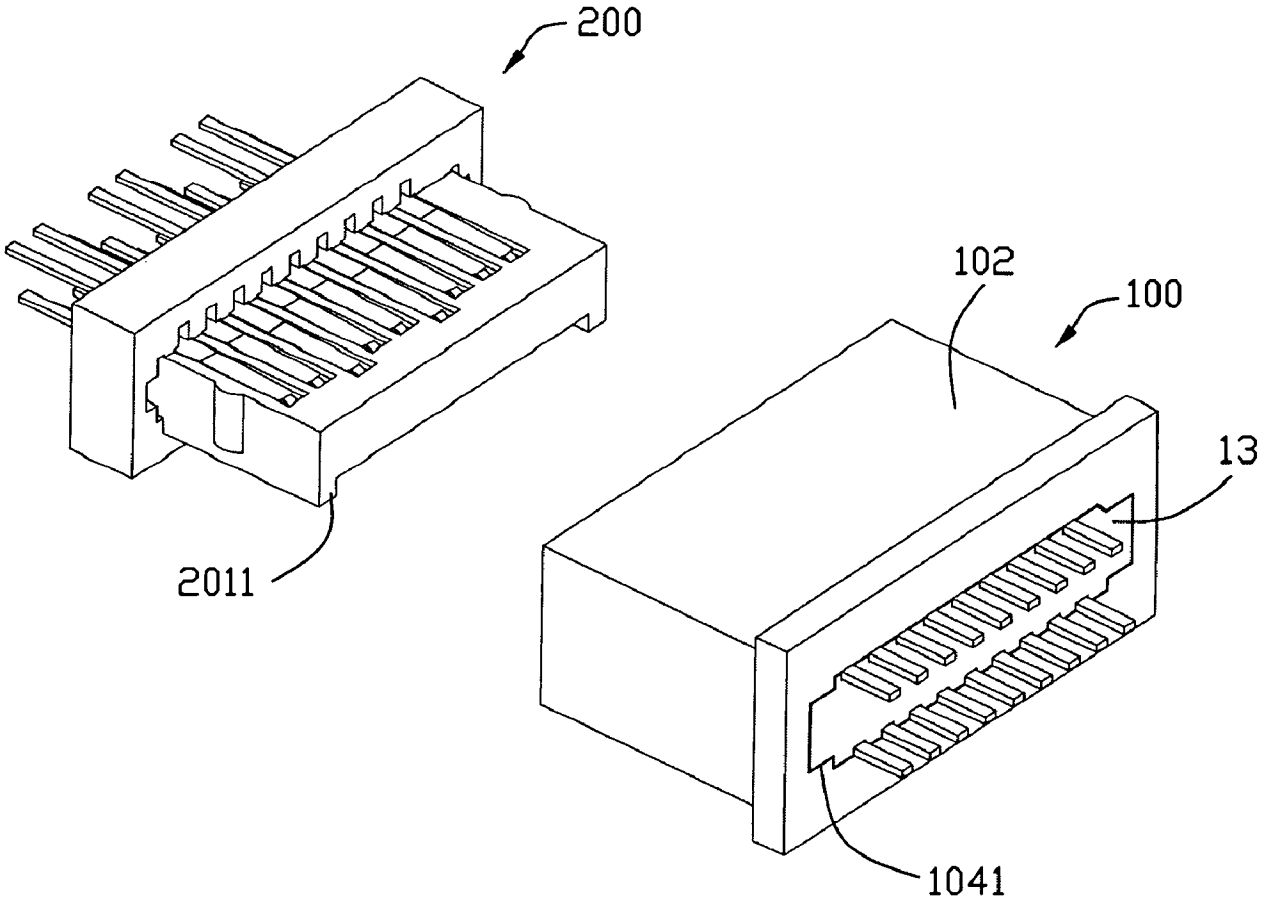
FIG. 2 is a view similar to FIG. 1, but taken from another aspect.
Figure 5:
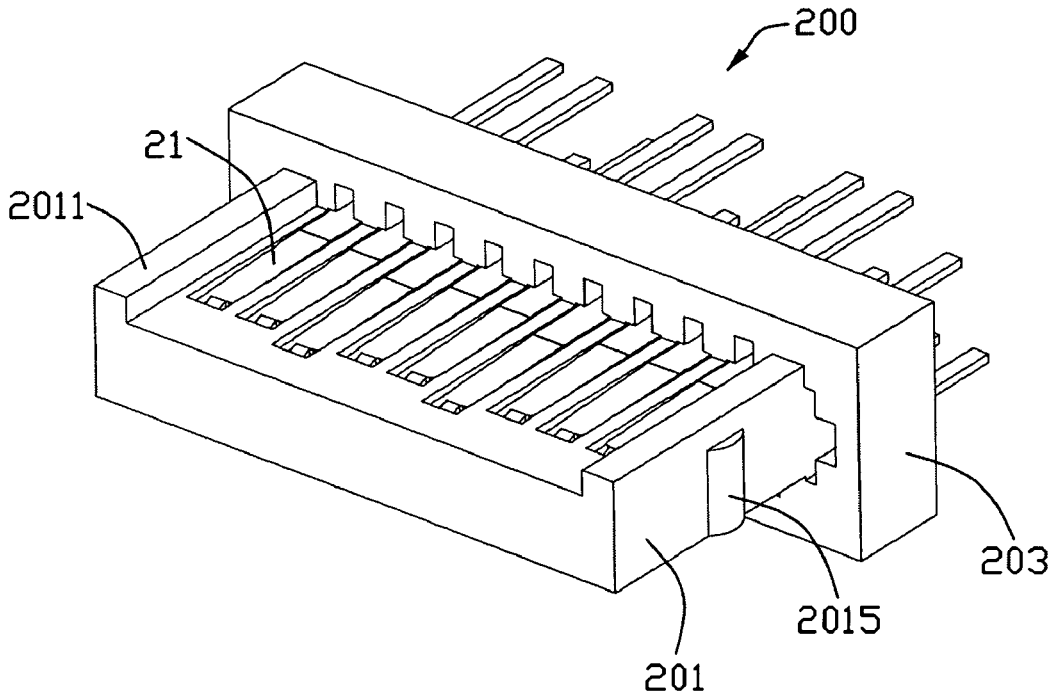
FIG. 5 is an assembled perspective view of the plug connector shown in FIG. 1.
Figure 6:
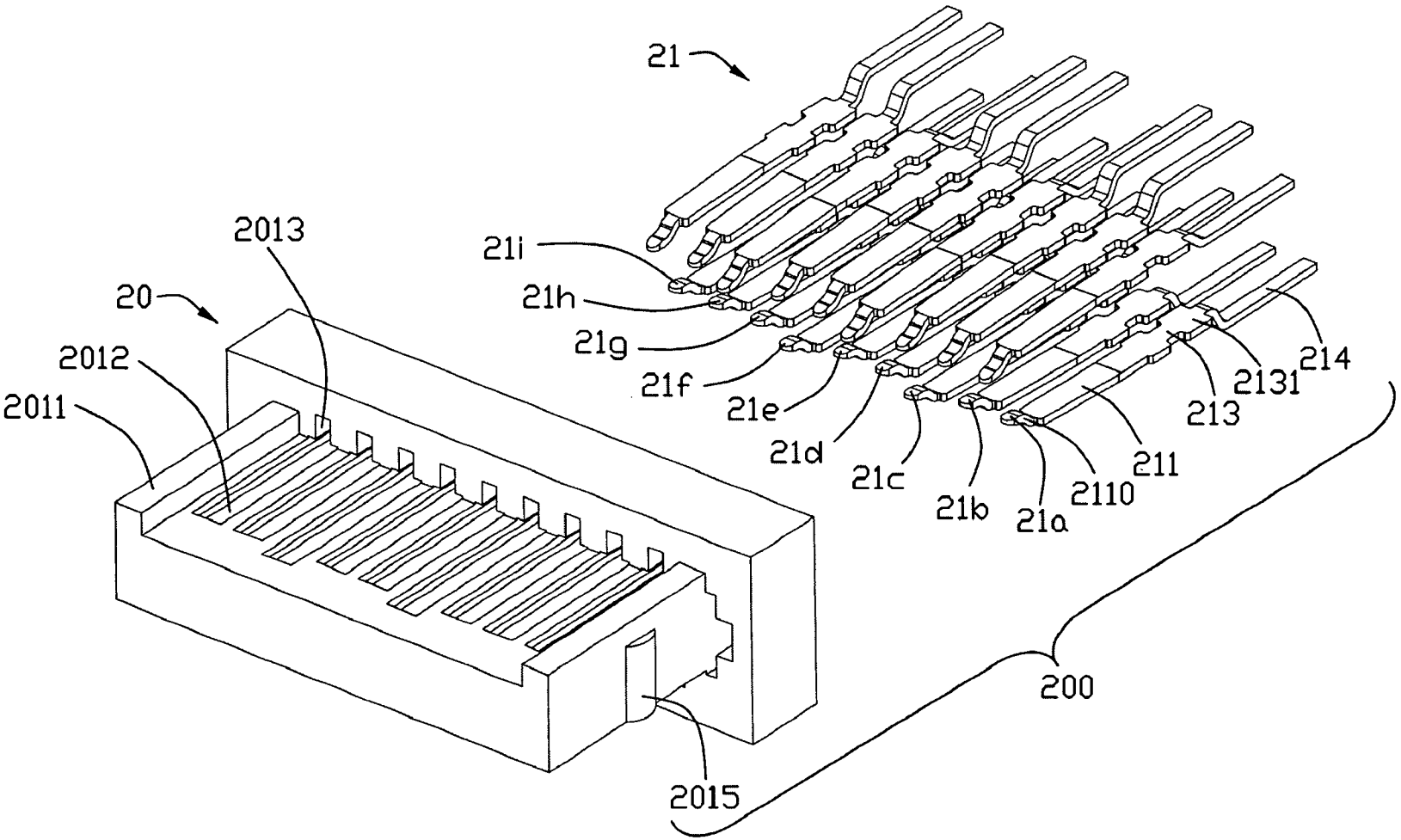
FIG. 6 is an exploded perspective view of the plug connector shown in FIG. 5.

Referring to FIGS. 1-2 and conjunction with FIGS. 5-6, the plug connector 200 can be plugged into the receptacle connector 100. As the cavity 1020 of the receptacle connector 100 is of n-shape, the plug connector 100 has a pair of leading portions 2011 on both sides to cooperate with the guiding slots 1023 of the receptacle connector 100. The plug connector 200 comprises a plug housing 20 and a plurality of plug contacts 21 assembled to the plug housing 20. The plug housing 20 has a main portion 201 and an enlarged portion 203 extending from the main portion 201 outwards, and the main portion 201 defines a plurality of passageways 2012 side by side, the passageways 2012 are extending forward and penetrating the enlarged portion 203 to form a number of passages 2013. The plug connector 200 also has a pair of locking portions 2015 protruding from outer sides of the leading portions 2011.

The plug contacts 21 of the plug connector 200 are also divided into a top group and a bottom group, the two groups are opposite to each other and in mirror relationship, but the arrangement orders of the two groups are reversed from each other. Each plug connector group includes nine juxtaposed plug connectors 12 on the same shape, and each plug connector 12 comprises a second mating portion 211 on a front end, a flat second tail portion 214 on a back end and a second retention portion 213 connected with the second mating portion 211 and the second tail portion 214. The second mating portions 211 are received in the passageways 2012. Each second retention portion 213 defines a plurality of barbs 2131 symmetrically. Each second mating portion 211 of the top group of plug contact 21 is extended from a front end of the second retention portion 213 forwards, finally bend downwards to form a second tip end 2110. The second tail portions 214 of the same group of plug contacts 21 are bent to locate on different surfaces.

The top group of plug contacts 21 are numbered as 21*a* to 21*i* respectively, and comprises two pairs of second differential signal contacts 21*a*, 21*b*, 21*d*, 21*e*, two second grounding contacts 21*c*, 21*f* (GND), a second positive signal contact 21*g* (+ data contact), a second negative signal contact 21*h* (– data contact) and a second power contact 21*i*. One of the two pairs of the second differential signal contacts 21*a*, 21*b* are used for receiving a high-speed data, and another pair 21*d*, 21*e* used for sending the high-speed data. The second differential signal contacts 21*a*, 21*d* are positive, and the second differential signal contacts 21*b*, 21*e* are negative. One of the second grounding contacts 21*c* is arranged between the two pairs of first differential signal contacts to reduce cross-talk. Another second grounding contact 21*f* is arranged between the second differential signal contacts 21*d*, 21*e* and the second data contacts 21*g*, 21*h* for preventing cross-talk. The second power contact 21*i* is located neighboring to the – data contact 21*h* and on an outer side of the – data contact 21*h*. The second tail portions 214 of the second grounding contacts 21*c*, 21*f* and the second power contact 21*i* in the top row are bent downwards, and the others are bent upwards to be in stagger relationship.

When assembly, the plug contacts 21 are inserted into the plug housing 20, the second mating portions 211 are received in the passageways 2012, and the second tip ends 2110 are embedded in the plug housing 20 to prevent the second mating portions 211 jumping out. The second retention portions 213 of the plug contacts 21 are retained in the passages 2013 of the plug housing 20 via the barbs 2131 thereon, the second tail portions 214 of the plug contacts 21 are extending beyond a front surface of the plug housing 20 and soldered to a print circuit board (not shown).

Figure 7:
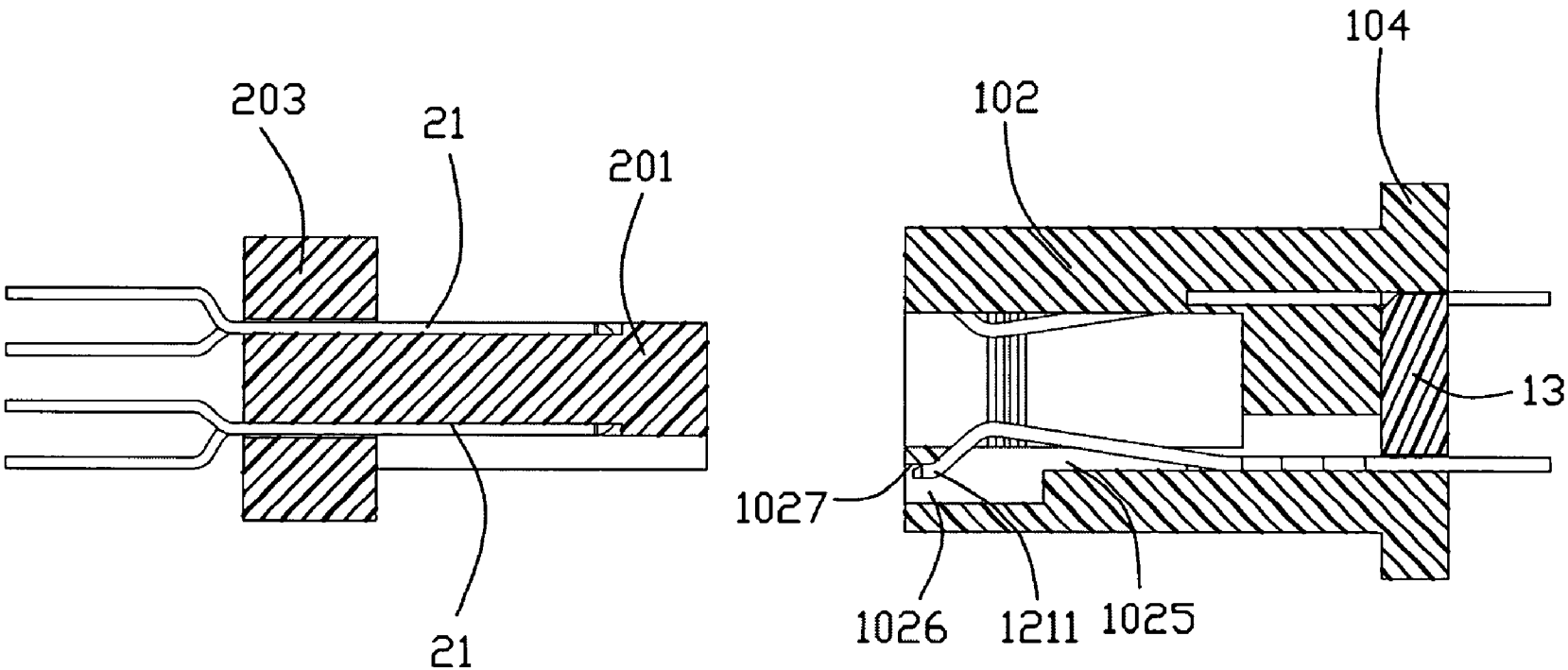
FIG. 7 is a cross-section view taken along line 7-7 of the FIG. 1.
Figure 8:
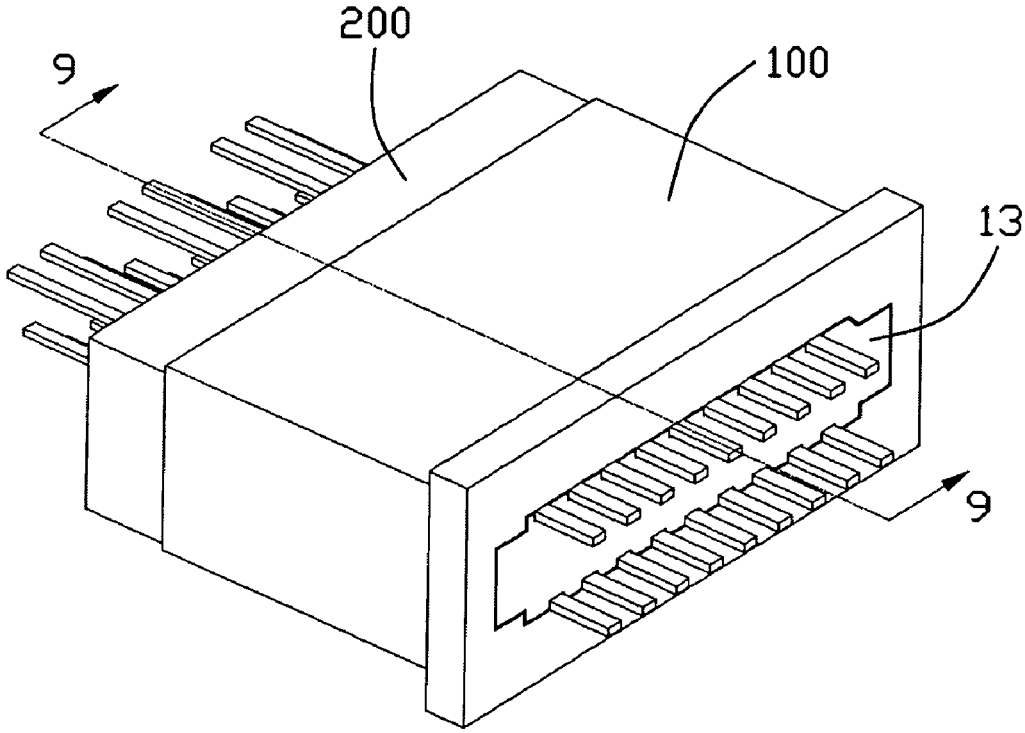
FIG. 8 is a perspective view of the electrical connector assembly, showing a state that the plug connector is fully inserted into the receptacle connector.
Figure 9:
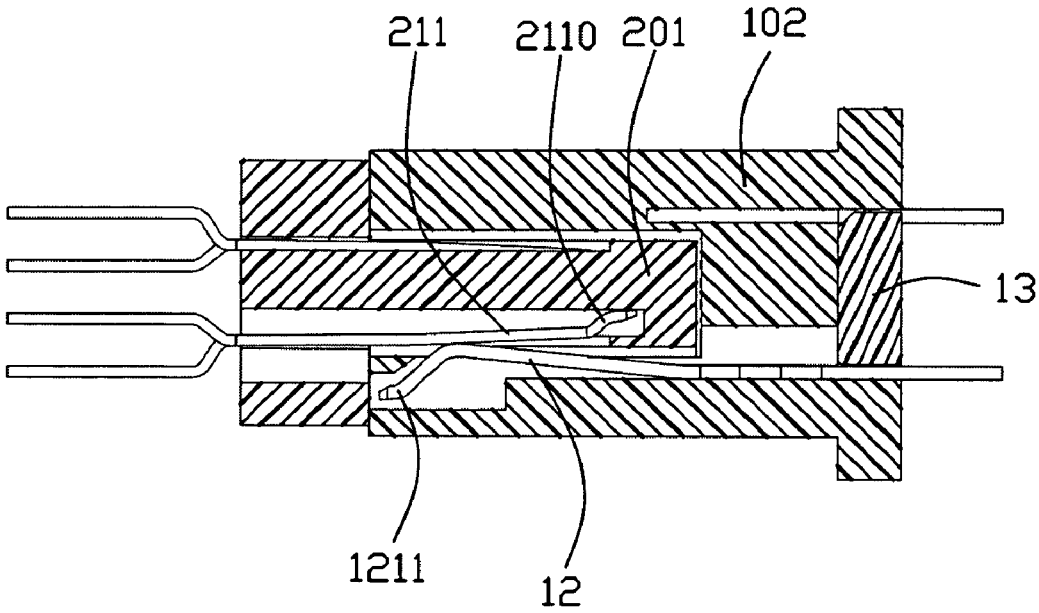
FIG. 9 is a cross-section view taken along line 9-9 of the FIG. 8.

Referring to FIGS. 1-2 and conjunction with FIGS. 7-9, when the plug connector 200 inserted into the cavity 1020 of the receptacle connector 100, the leading portions 2011 of the plug connector 200 slide along the guiding slots 1023, the plug contacts 21 are mating with the receptacle contacts 12, and the locking portions 2015 skate over corresponding ribs 2018 to make the plug connector 200 lock with the receptacle connector 100. The receptacle contacts 12*a*-12*i* contact with the corresponding plug contacts 21*a*-21*i*, a plug connector 200 on a back panel transmit high-speed signals from a computer case to a receptacle connector 100, and the receptacle connector 100 transmits the high-speed signals to another receptacle connector linking with thereof by a cable, then another plug connector mating with the another receptacle connector transmits the signals to a main board in the computer. The process of the high-speed signal transmitted from the main board in the computer to the back panel of the computer case is opposite to before mentioned process.

Figure 10:
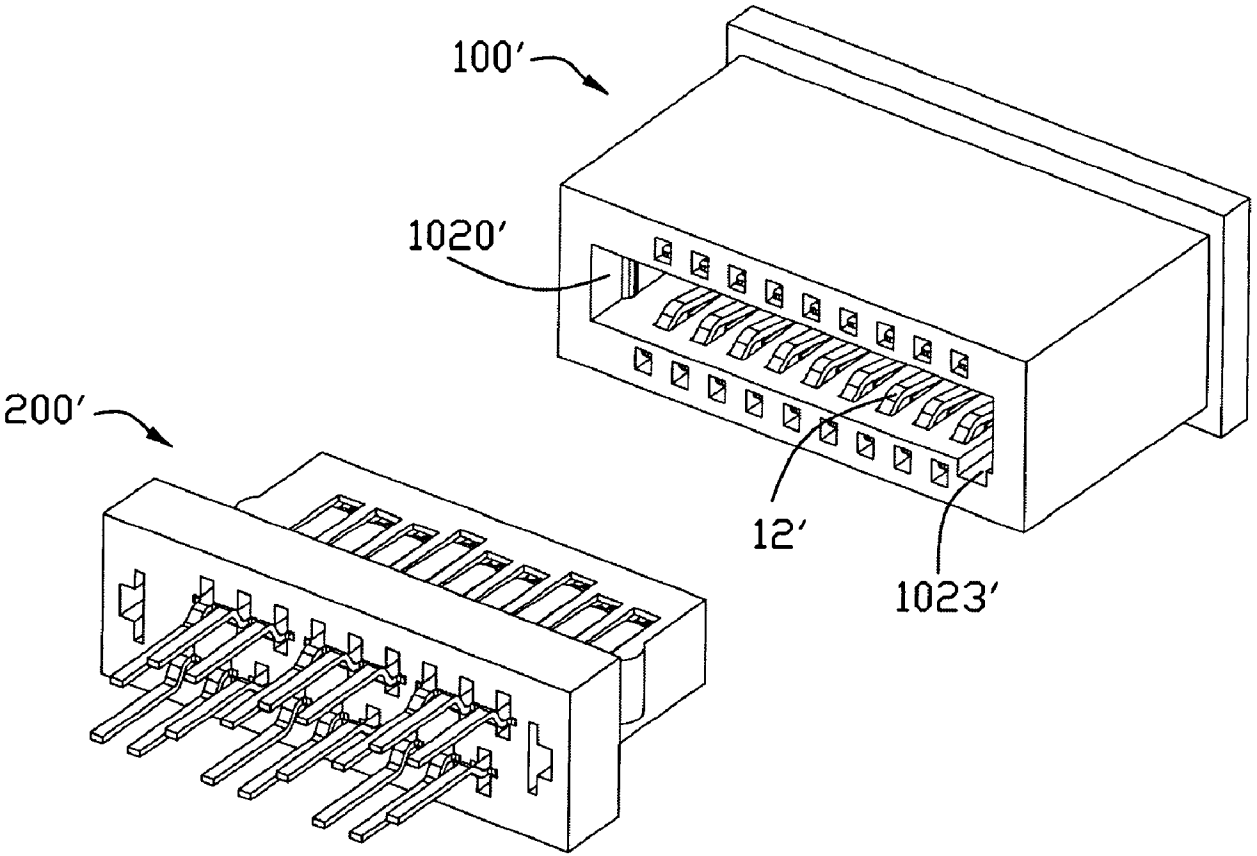
FIG. 10 is an assembled view of the electrical connector assembly of another embodiment according to the present invention.

Referring to FIG. 10, in another embodiment of the present invention, a receptacle connector 100' mating with a plug connector 200' is similar to the receptacle connector 100, the arrangement of plug contacts 12' is same as the plug contacts 12, the only difference is that a cavity 1020' of the receptacle connector 100' is of L-shape, that is to say, the receptacle connector 100' has a guiding slot 1023' on one side, and the plug connector 200' has a leading portion (not shown) on the corresponding side.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly, comprising: a receptacle connector having a receptacle housing and a plurality of receptacle contacts received in the receptacle housing, the receptacle housing comprising a base portion and an expansion portion extending outwards from the base portion; and a plug connector mating with the receptacle connector, the plug connector comprising a plug housing and a plurality of plug contacts retained in the plug housing, each of the receptacle contacts and the plug contacts defining a mating portion, a retention portion retained with associated housing and a tail portion extending beyond the associated housing; wherein the receptacle contacts and the plug contacts are divided into two groups respectively, each group of contacts comprises two pairs of differential signal contacts and a grounding contact arranged between the two pairs of differential signal contacts, and one of the two pairs of differential signal contacts are located on an outer side of the group of contacts, wherein the two groups of receptacle contacts are opposite to each other, wherein the other pair of differential signal contacts are arranged between two grounding contacts, wherein each group of contacts comprises a positive signal contact and a negative signal contact, and a grounding contact is disposed between one pair of differential signal contacts and the positive signal contact.

2. The electrical connector assembly as claimed in claim 1, wherein the receptacle connector has a cavity receiving the plug connector, a rib is defined in the cavity, the plug connector has a locking portion protruding outwards, and the locking portion is latched with the rib when the plug connector plugged into the receptacle connector.

3. The electrical connector assembly as claimed in claim 2, wherein the cavity of the receptacle connector has at least one guiding slot.

4. The electrical connector assembly as claimed in claim 3, wherein the plug connector has at least one leading portion slidable along the guiding slot.

5. The electrical connector assembly as claimed in claim 1, wherein the tail portions of the plug contacts in the same group are bent to be located on different surfaces.

6. The electrical connector assembly as claimed in claim 5, wherein the plug housing includes a main portion, an enlarged portion extending outwards and a plurality of passageways.

7. A receptacle connector, comprising: a housing with a cavity;

a plurality of contacts received in the housing, and each contact comprising a curved mating portion and a retention portion retained in the housing; and a spacer assembled to a back end of the housing, and having a plurality of gaps supporting the contacts;

wherein the contacts are divided into two groups located on opposite surfaces of the cavity, and each group of contacts comprises two pairs of differential signal contacts transmitting signal and a grounding contact arranged between the two pairs of differential signal contacts, one pair of the differential signal contacts are located on an outer side of the group of contacts, wherein the two groups of contacts are opposite to each other, wherein the other pair of differential signal contacts are disposed between two grounding contacts, wherein each group of contacts also comprises a positive signal contact and a negative signal contact, and a grounding contact is disposed between one pair of differential signal contacts and the positive signal contact.

8. The receptacle connector of claim 7, wherein at least one guiding slot is defined in the cavity, and at least one barb is defined in the cavity locking with a complementary connector.

9. An electrical connector comprising: an insulative housing defining a mating port; first and second rows of contacts disposed in the mating port and spaced from each other in a vertical direction, each of said contacts extending along a front-to-back direction perpendicular to said vertical direction, said first row of contacts including a first differential pair of signal contacts, a first grounding contact, a second differential pair of signal contacts, a second grounding contact, a pair of positive and negative signal contacts and a power contact arranged in sequence along a first transverse direction perpendicular to said vertical direction and said front-to-back direction, wherein said second row of contacts includes said first differential pair of signal contacts, said first grounding contact, said second differential pair of signal contacts, said second grounding contact, said pair of positive and negative signal contacts and said power contact in the same sequence while in a second transverse direction opposite to said first transverse direction, wherein said first row of contacts and said second row of contacts are offset from each other in said first transverse direction so as to form an alternate arrangement with each other along said first transverse direction so that the first differential pair of signal contacts in one row intimately confront either a grounding contact or a power contact in the other row in a triangular manner.

* * * * *